US005362047A

United States Patent [19]

Shaw et al.

[11] Patent Number: 5,362,047

[45] Date of Patent: Nov. 8, 1994

[54] GOLD CLUB HEADS WITH FACE PIECES OF A THICKNESS VARYING IN TOE TO HEEL AND/OR TOP EDGE TO SOLE DIRECTIONS

[75] Inventors: Michael Shaw; Brian F. Machin, both of Wakefield, England

[73] Assignee: Dunlop Slazenger International, Ltd., Normanton, England

[21] Appl. No.: 180,103

[22] Filed: Jan. 11, 1994

Related U.S. Application Data

[63] Continuation of Ser. No. 951,450, Sep. 25, 1992, abandoned.

[30] Foreign Application Priority Data

Sep. 28, 1991 [GB] United Kingdom ..... 120600

[51] Int. Cl.[5] ..... A63B 53/08

[52] U.S. Cl. ..... 273/77 A; 273/167 J; 273/173

[58] Field of Search ..... 273/167 R, 167 J, 173, 273/78, 77 A, 167 H, 169, 167 F, 175, 168

[56] References Cited

U.S. PATENT DOCUMENTS

| | | | |
|---|---|---|---|
| 1,671,956 | 5/1928 | Sime | 223/169 |
| 4,214,754 | 7/1980 | Zebelean | 273/167 H |
| 4,432,549 | 2/1984 | Zebelean | 273/167 H |
| 4,754,969 | 7/1988 | Kobayashi | 273/78 |
| 4,884,808 | 12/1989 | Retzer | 273/167 J |
| 4,957,294 | 9/1990 | Long | 273/167 H |
| 5,028,049 | 7/1991 | McKeighen | 273/167 H |
| 5,163,682 | 11/1992 | Schmidt et al. | 273/167 J |

*Primary Examiner*—Vincent Millen
*Assistant Examiner*—Steven B. Wong
*Attorney, Agent, or Firm*—Lorusso & Loud

[57] ABSTRACT

In a set of golf iron heads, one of the components for each of the heads is a face-piece forming at least a portion of a striking face of the head, the thickness of the face-piece increasing from the toe to the heel of the head in at least one iron of the set and increasing from the heel to the toe of the head in at least one other iron of the set. Alternatively, the thickness of the face-piece increases from the top edge to the sole in at least one head of the set, and increases from the sole to the top edge in at least one other head of the set.

14 Claims, 5 Drawing Sheets

GOLD CLUB HEADS WITH FACE PIECES OF A THICKNESS VARYING IN TOE TO HEEL AND/OR TOP EDGE TO SOLE DIRECTIONS

CROSS-REFERENCE TO RELATED APPLICATION

This is a continuation of patent application Ser. No. 07/951,450, filed Sep. 25, 1992, now abandoned in the name of Michael Shaw.

BACKGROUND OF THE INVENTION (1) Field of the Invention

The present invention relates to the head structure of golf clubs, particularly golf irons, and is directed more particularly to club heads having face pieces as components thereof, the face pieces being of a thickness which increases or decreases from toe to heel and/or from top edge to sole.

(2) Description of the Prior Art

There are several clubs in a set of irons, each one designed in terms of shaft length, head weight, head weight distribution, swing weight, loft and lie, to confer certain playing characteristics.

SUMMARY OF THE INVENTION

An object of the present invention is to improve the performance characteristics of golf irons.

According to one general aspect of the present invention, in a set of golf iron heads, at least part of the striking face of each head is a material selected for characteristics desired for the particular iron in the set, and at least some of the heads are multi-component heads in which at least part of the striking face area of the head comprises at least one discrete face-piece component of material having at least one characteristic different from the rest of the head.

According to the present invention, there is provided a multi-component golf iron head in which at least part of the striking face area of the head comprises at least one face-piece component, the face-piece component(s) being: (a) of material selected for its surface friction and/or flexural modulus characteristics affecting the spin behavior of golf balls when struck by the head, and/or (b) of specific gravity and/or geometric configuration selected to contribute to the desired weight distribution in the head.

When only part of the striking face comprises at least one face-piece component, normally the outer surface of the face-piece component(s) will be level with the adjacent surface of the striking face, and normally the face piece component(s) will be located at least at the normal position of impact with a golf ball by a competent golfer, such as at the "sweet spot" area, usually the central area, of the striking face.

The head may have a main body, or core, of one or more components, and a face-piece of one or more components attached or attachable thereto.

By means of the present invention, it is possible to optimize playing characteristics and, by careful selection of components, confer a range of performance attributes to suit a wide variety of golfers and playing conditions.

Some clubs are designed primarily for distance and some primarily for control. These characteristics can be enhanced by careful selection of the material and geometric configurations of the face-piece.

Since the face-piece component(s) can be selected to have characteristics which are independent of the properties desired for the rest of the head, the materials of which the main body component(s) are formed may be selected from a wider range than those considered suitable for one-piece heads.

By way of example, materials for the main body component(s) include metals, e.g. steel (forged or cast, stainless or mild), metal alloys, e.g. zinc/aluminum or beryllium/copper, thermoplastic or thermoset plastics or resins, carbon fiber or other fiber-reinforced plastics, and metal matrix composites.

Materials of the face-piece component(s) may be selected to confer characteristics particularly desired for the striking face by selection of properties such as weight, friction, flexural modulus, resilience, hardness and aesthetic appearance (e.g. color). For example, ceramics, thermoplastics, thermosets, metals, elastomers, and particle or fiber-reinforced composites may be employed. Examples of reinforcing fibers for fiber-reinforced composites are those of carbon, glass, ceramics and textiles such as aramids (e.g. "Kevlar"). Examples of polymer matrices of the composite are nylons, epoxy resins and polyester resins.

One important characteristic for which the present invention is advantageous is the ability of the head to produce and/or control spin of a golf ball.

Clubs which confer high spin are desirable for the better player, to enhance control and manipulability. But clubs which generate low spin are desirable for poor players, to improve distance and to reduce undesired hooking and slicing. For all golfers, increased backspin tends to reduce roll and increase drag, thereby reducing travel distance. This is more of a penalty for poor golfers than for good golfers.

The ability to produce and/or control spin depends significantly on the friction and flexural modulus characteristics of the head face.

In a preferred embodiment of the invention, there is provided a set of multi-component golf iron heads, each having one or more face-piece component(s) of low friction and flexural modulus characteristics in order to minimize spin and maximize distance and straightness.

Examples of suitable low friction face-piece component materials, embracing both low and high flexural modulus materials, are PTFE, ceramic materials, glass, metals, nylon, polycarbonate, etc. The head main body component(s) may be of materials conventionally employed for iron club heads.

In another preferred embodiment of the invention, there is provided a set of club heads with face-piece component(s) having friction and/or flexural modulus characteristics on a graduated scale, using materials of low friction and low flexural modulus for the long irons, and using materials of progressively increasing friction and flexural modulus through to the shortest irons, thereby providing longest distance for the long distance, or "long", irons and best control for the short distance, or "short", irons.

A further important characteristic for which the present invention is advantageous is weight distribution in the head. It is well known that the weight distribution in the head affects the tendency of the head to rotate about the shaft axis during ball/club impact, especially when the ball/club impact occurs in a position other than the "sweet spot", i.e. the position on the face directly aligned along the swing path with the center of rotation of the head. This rotational tendency can be influenced, i.e., either increased or decreased, by changing the weight distribution in the head. For instance, it is well known to move weight elements towards the toe and heel of the club in order to produce clubs in which this rotational tendency is reduced. Clubs which have such a reduced rotational tendency with off-center impacts generally will propel the ball straighter than other clubs. Conversely, increasing the weight immediately behind the impact position increases this rotational tendency and such clubs generally will propel the ball less accurately for off-center impacts. Similarly, redistributing weight in the vertical plane affects club performance. Moving weight elements towards the sole of the club lowers the center of gravity of the head which, in turn, tends to increase ball trajectory for any given impact position on the face.

The present invention enables a greater latitude in weight distribution and geometry of a golf club head by selection of face-piece materials and main body materials having selected specific gravities.

According to one preferred embodiment of the invention, there is provided a multi-component golf club head having a face-piece component of specific gravity lower than that of the main body, thereby providing additional weight for redistribution to the heel and/or toe and/or sole portions of the head and thus improving the accuracy and playability of the club.

Use of such a face-piece component also permits design of a golf club head having the benefits of a cavity back head design (i.e., heel/toe/sole weight distribution), but with a more traditional blade shape.

According to another preferred embodiment of the invention, there is provided a set of club heads wherein the specific gravity of the face-piece components increases from the long irons to the short irons.

The face-piece materials and geometric configurations may be selected on the basis of either or both frictional and weight distribution characteristics.

The face-piece component(s) may be provided with a geometric configuration designed to enhance specific performance. For example, the face-piece component(s) may have a thickness variation in the vertical plane (i.e., in the top edge to sole direction) and/or in the lateral plane (i.e., in the heel to toe direction), in order to influence weight distribution. In the case of face-piece materials which have relatively low flexural modulus under impact, relative hardness, feel and spin may also be adjusted by alteration of the face-piece geometry.

Employment of a face-piece component having a specific gravity less than that of the main body component(s) and having a vertical or lateral thickness variation is especially useful to facilitate weight distribution in the head.

A low specific gravity face-piece component having a thickness which increases in the toe to heel direction provides main body mass for distribution in the toe of the head, and conversely, such a face-piece having a thickness which increases in the heel to toe direction provides main body mass for distribution in the heel of the head. Accordingly, in a set of iron heads, the center of gravity of a head can be located nearer the toe for the long irons and progressively nearer the heel for the short irons.

A low specific gravity face-piece component having a thickness which decreases in the top edge to sole direction provides main body mass for distribution in the sole, thereby providing a head with a low center of gravity which tends to confer a high launch angle to balls struck by the iron, and consequently usually a high ball trajectory. Conversely, such a face-piece component having a thickness which increases in the top edge to sole direction provides main body mass for distribution in the top edge, thereby providing a head with a high center of gravity which tends to confer a low launch angle to balls struck by the iron and consequently usually a lower ball trajectory. It will be appreciated that the trajectory of a ball also depends on the spin imparted to the ball. However, generally, heads having a low center of gravity are more suitable for inexperienced golfers and heads having a high center of gravity are more suitable for experienced golfers. The present invention provides a means of "fine tuning" iron heads to suit the ability of a golfer by selection of face-piece component thickness gradation and complementary main body weight distribution to provide appropriate centers of gravity of the heads.

If desired, a face-piece component may have a multi-layered construction in order to generate specific combinations of weight, hardness and frictional characteristics.

The face-piece component(s) may be attached to the main body by various secure means, for instance by bonding (adhesive or melt-bonding, welding, soldering, brazing), by securing means such as screws, bolts or rivets, and/or by mechanically interlocking complementary formations on the components.

The face-piece component(s) may be attached to the main body such that the rear surface of the face-piece is flush with the main body, or such that there is a cavity between the rear surface and the main body, or such that at least part of the rear surface is exposed at the back of the head.

The face-piece component(s) may be designed to be detachable to enable replacement of damaged or worn components, or to change the playing characteristics of the club.

The aforementioned features of the invention may appear either singly or in combination. For example, there may be a set of irons having face-piece components graded in friction characteristics and weight characteristics with distinctive colors in each iron, to generate optimization in spin, accuracy and distance for each club and to facilitate identification.

It will be understood from the above description that golf clubs having a wide variety of performance, appearance and feel characteristics may be obtained by means of the present invention.

BRIEF DESCRIPTION OF THE DRAWINGS

The invention is illustrated, by way of example, in the accompanying drawings in which.

DESCRIPTION OF THE PREFERRED EMBODIMENTS

Figure 1:
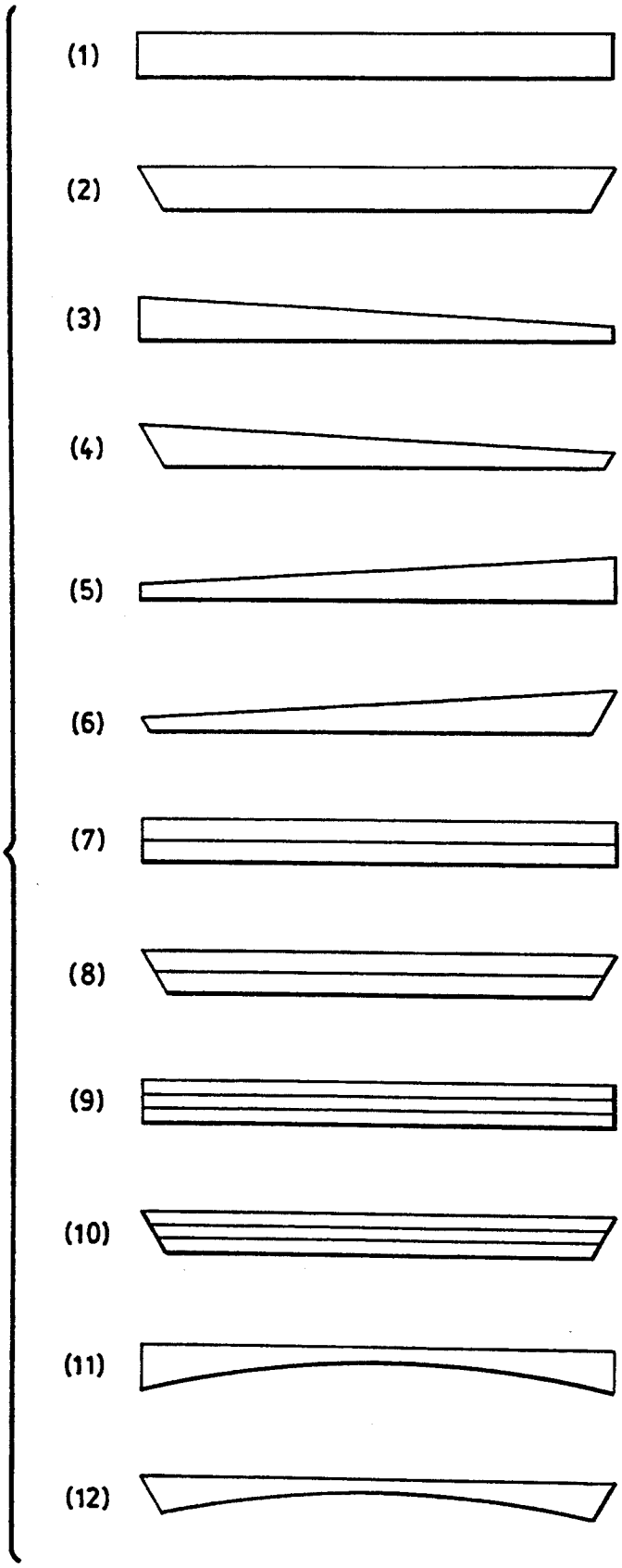
FIG. 1 shows twelve examples, numbered (1)–(12), of face piece components in accordance with the invention, each of the examples being shown in a top plan view. Examples (7)–(10) are examples of components having a multi-layered, laminate, construction.
Figure 2:
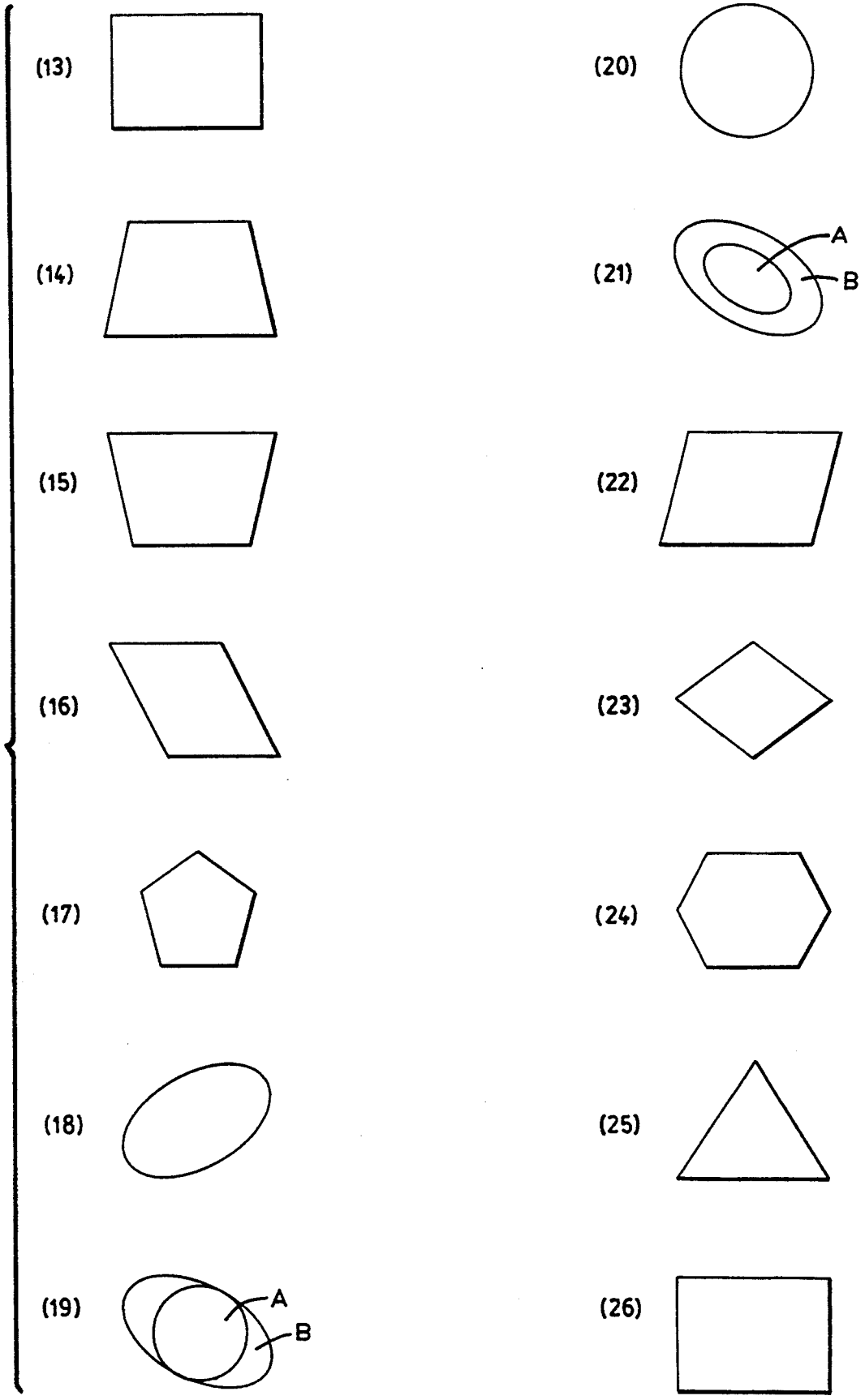
FIG. 2 shows fourteen examples, numbered (13)–(26), of face-piece components in accordance with the invention, each of the examples being shown in front elevation. Examples (19) and (21) are examples of multi-component face-pieces comprising two components, A and B.
Figure 3:
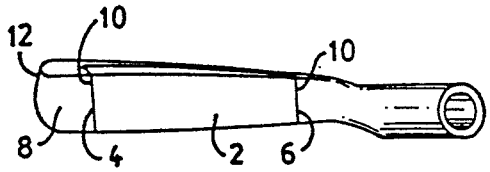
FIG. 3 is a top plan view of a golf iron head illustrative of an embodiment of the invention.
Figure 4:
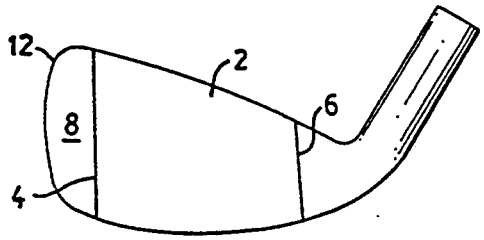
FIG. 4 is a front elevational view of the head of FIG. 3.

Some features exemplified by FIGS. 3 to 43 are as follows:

In FIGS. 3 and 4, a face-piece component 2 has lateral edges 4, 6 which are substantially parallel at a head face 8 and which diverge rearwardly to provide a dovetail mortise joint 10 with a complementary formation in a main body portion 12 of the head.

Figure 5:
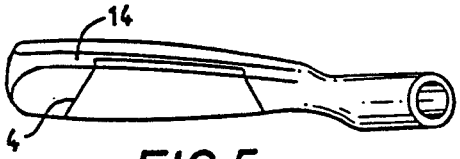
FIG. 5 is a top plan view of an alternative embodiment of the invention.
Figure 6:
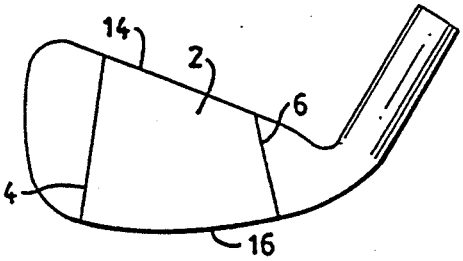
FIG. 6 is a front elevational view of the head of FIG. 5.

In FIGS. 5 and 6, the face-piece component 2 has lateral edges 4, 6 which are divergent from a top edge 14 to a sole 16 of the head.

Figure 7:
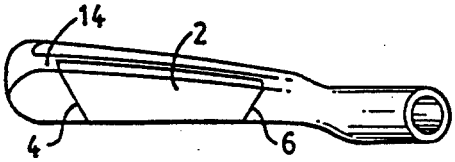
FIG. 7 is a top plan view of another alternative embodiment of the invention.
Figure 8:
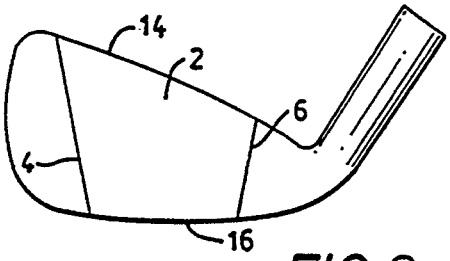
FIG. 8 is a front elevational view of the head of FIG. 7.

In FIGS. 7 and 8, the face-piece component has lateral edges 4, 6 which are divergent from the sole to the top edge of the head.

Figure 9:
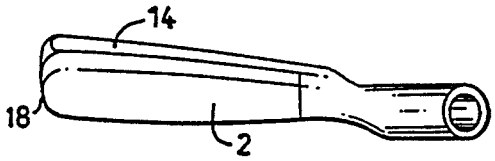
FIG. 9 is a top plan view of another alterative embodiment of the invention.
Figure 10:
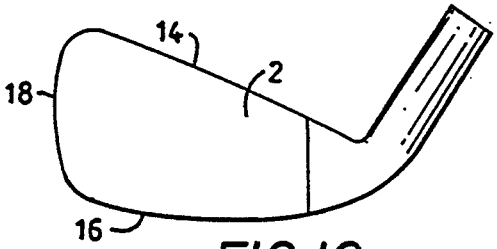
FIG. 10 is a front elevational view of the head of FIG. 9.

In FIGS. 9 and 10, the face-piece component 2 extends completely to a toe 18 of the head, as well as to the top edge 14 and sole 16 of the head, and substantially completely covers the face of the head.

Figure 11:
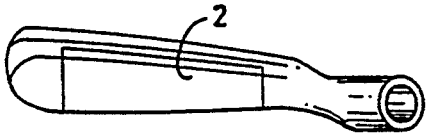
FIG. 11 is a top plan view of another alternative embodiment of the invention.
Figure 12:
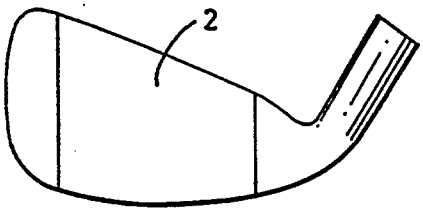
FIG. 12 is a front elevational view of the head of FIG. 11.

In FIGS. 11 and 12, the face-piece component 2 has the same face shape as that of FIG. 3, but does not diverge rearwardly.

Figure 13:
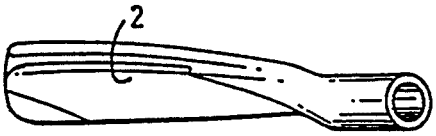
FIG. 13 is a top plan view of another alternative embodiment of the invention.
Figure 14:
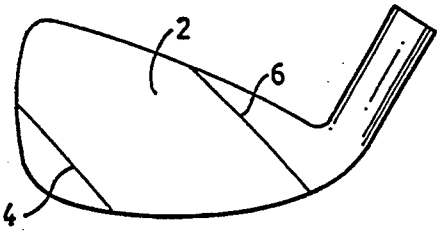
FIG. 14 is a front elevational view of the head of FIG. 13.

In FIGS. 13 and 14, the face-piece component 2 has substantially parallel lateral edges 4, 6 at an angle of about 45° to a center line of the face.

Figure 15:
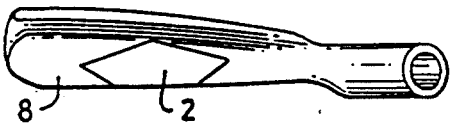
FIG. 15 is a top elevational view of another alternative embodiment of the invention.
Figure 16:
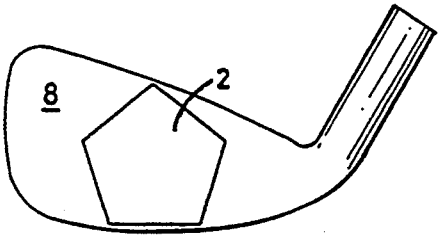
FIG. 16 is a front elevational view of the head of FIG. 15.

In FIGS. 15 and 16, the face-piece component 2 has a polyhedral face shape, exemplified by a regular pentahedron, positioned centrally of the face 8 of the head.

Figure 17:
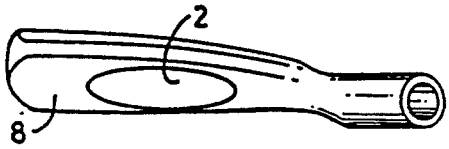
FIG. 17 is a top plan view of another alternative embodiment of the invention.
Figure 18:
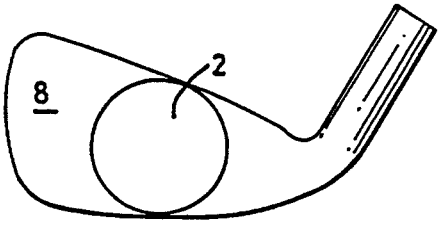
FIG. 18 is a front elevational view of the head of FIG. 17.

In FIGS. 17 and 18, the face-piece component 2 has a circular face shape positioned centrally of the face 8 of the head.

Figure 19:
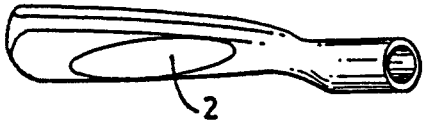
FIG. 19 is a top plan view of another alternative embodiment of the invention.
Figure 20:
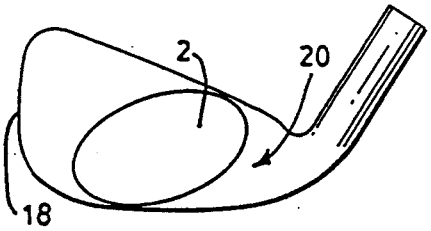
FIG. 20 is a front elevational view of the head of FIG. 19.

In FIGS. 19 and 20, the face-piece component 2 has an elliptical face shape with its greatest diameter inclined from high at a heel side 20 to low at the toe side 18.

Figure 21:
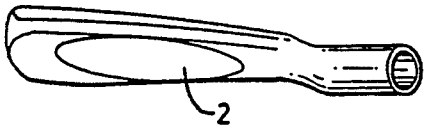
FIG. 21 is a top plan view of an alternative embodiment of the invention.
Figure 22:
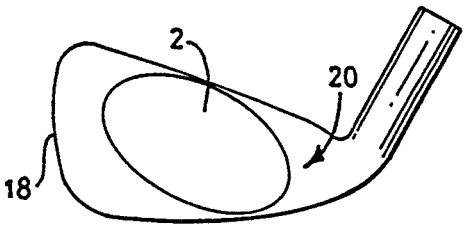
FIG. 22 is a front elevational view of the head of FIG. 21.

In FIGS. 21 and 22, the face-piece component 2 has an elliptical face shape with its greatest diameter inclined from low at the heel side 20 to high at the toe side 18.

Figure 23:
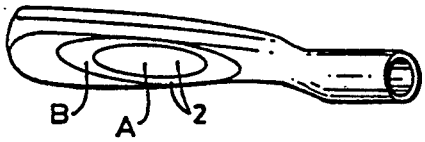
FIG. 23 is a top plan view of another alternative embodiment of the invention.
Figure 24:
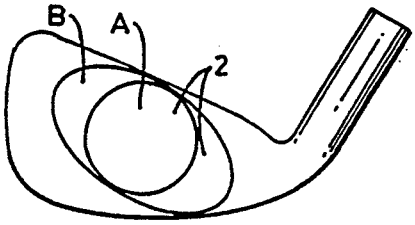
FIG. 24 is a front elevational view of the head of FIG. 23.

In FIGS. 23 and 24, the head has a multi-component face-piece 2 comprising a circular inner component A and an inclined elliptical outer component B.

Figure 25:
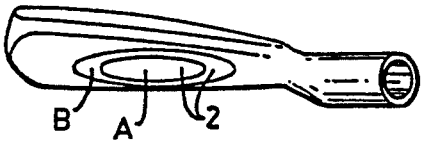
FIG. 25 is a top plan view of another alterative embodiment of the invention.
Figure 26:
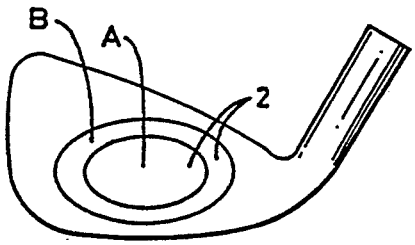
FIG. 26 is a front elevational view of the head of FIG. 25.

In FIGS. 25 and 26, the head has a multi-component face-piece 2 comprising an elliptical inner component A and an elliptical outer component B.

Figure 27:
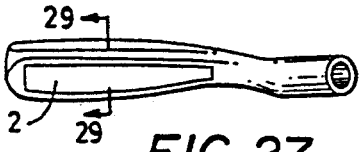
FIG. 27 is a top plan view of another alternative embodiment of the invention.
Figure 28:
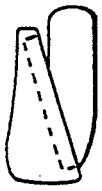
FIG. 28 is a toe end elevational view of the head of FIG. 27.
Figure 29:
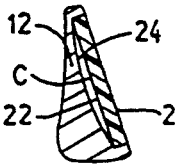
FIG. 29 is a sectional view taken along line 29—29 of FIG. 27.

In FIGS. 27–29, the head has a closed cavity or hollow C between a rear uniplanar surface 22 of the face-piece component 2 and a concave surface 24 of the body of the head.

Figure 30:
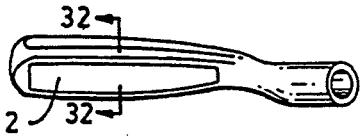
FIG. 30 is a top plan view of another alternative embodiment of the invention.
Figure 31:
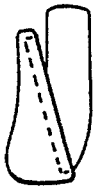
FIG. 31 is a toe end elevational view of the head of FIG. 30.
Figure 32:
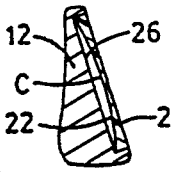
FIG. 32 is a sectional view taken along line 32—32 of FIG. 30.

In FIG. 30–32, the face-piece component 2 has a concave rear surface 22 and the head has a closed cavity C bounded by the rear surface 22 of the face-piece component 2 and a surface 26 of the body 12 of the head.

Figure 33:
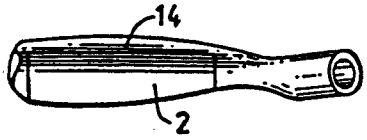
FIG. 33 is a top plan view of another alternative embodiment of the invention.
Figure 34:
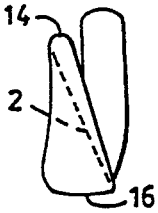
FIG. 34 is a toe end elevational view of the head of FIG. 33.

In FIGS. 33 and 34, the face-piece component 2 has a thickness which increases in the direction from the sole 16 to the top edge 14 of the head.

Figure 35:
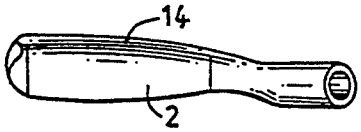
FIG. 35 is a top plan view of another alternative embodiment of the invention.
Figure 36:
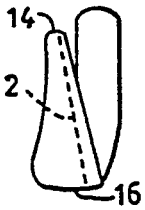
FIG. 36 is a toe end elevational view of the head of FIG. 35.

In FIGS. 35 and 36, the face-piece component 2 has a thickness which decreases in the direction from the sole 16 to the top edge 14 of the head.

Figure 37:
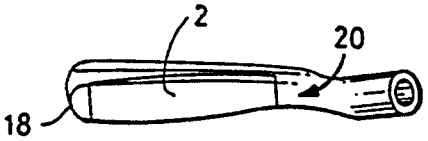
FIG. 37 is a top plan view of another alternative embodiment of the invention.
Figure 38:
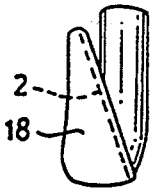
FIG. 38 is a toe end elevational view of the head of FIG. 37.

In FIGS. 37 and 38, the face-piece component 2 has a thickness which decreases in the direction from the heel 20 to the toe 18 of the head.

Figure 39:
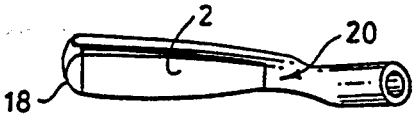
FIG. 39 is a top plan view of another alternative embodiment of the invention.
Figure 40:
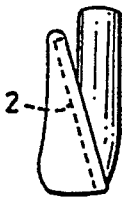
FIG. 40 is a toe end elevational view of the head of FIG. 39.

In FIGS. 39 and 40, the face-piece component 2 has a thickness which increases in the direction from the heel 20 to the toe 18 of the head.

Figure 41:
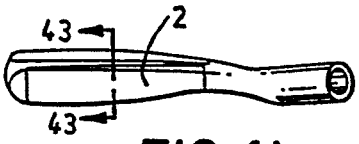
FIG. 41 is a top plan view of still another alternative embodiment of the invention.
Figure 42:
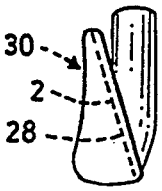
FIG. 42 is a toe end elevational view of the head of FIG. 41.
Figure 43:
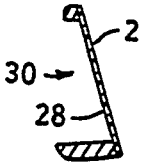
FIG. 43 is a sectional view taken along line 43—43 of FIG. 41.

In FIGS. 41–43, the head has a face-piece component 2 which provides at least part of a surface 28 of the back of the head, such as at least part of the surface of an open cavity 30 at the back of the head, as shown diagrammatically by the section 43—43.

The accompanying drawings merely show some examples of face-piece components and golf club heads in accordance with the invention and it will be appreciated that there is a multitude of additional variations of shape and construction of face-piece components and golf club heads within the scope of the invention as defined herein.

We claim:

1. In a set of golf iron heads, a plurality of said heads each including a plurality of components, one of said components for each of said heads comprising a face-piece component forming at least a portion of a striking face of said head, said face-piece component being of a material different from the material of the remainder of said head, and the thickness of said face-piece component increasing from the toe to the heel of the head in at least one iron of said set and increasing from the heel to the toe of the head in at least one other iron of said set.

2. The set of golf iron heads according to claim 1 wherein said face-piece component is of a multi-layered construction.

3. The set of golf iron heads according to claim 1 wherein said face-piece component is attached to a main body portion of said head by mechanically interlocking complementary formations.

4. The set of golf iron heads in accordance with claim 3, wherein said main body portion is of metal and said face-piece is of a material selected from a group consisting of polytetrafluoroethylene, ceramics, glass, metals, nylon, and polycarbonates.

5. The set of golf iron heads in accordance with claim 3, wherein said main body portion is of a material selected from a group consisting of metallic materials, thermoplastics, thermoset plastics, fiber-reinforced plastics, and metal matrix materials.

6. The set of golf iron heads in accordance with claim 5, wherein said face-piece component is of a material selected from a group consisting of thermoplastics, thermoset materials, elastomers, ceramics, particle-reinforced composites, and fiber-reinforced composites.

7. The set of golf iron heads in accordance with claim 5 wherein said face-piece component is of a fiber-reinforced polymer and said reinforcing fiber is of a material selected from a group consisting of carbon, glass, ceramics and textiles, and said polymer is of a material selected from a group consisting of nylon, epoxy resins, and polyester resins.

8. The set of golf iron heads in accordance with claim 1, wherein a rear surface of said face-piece component is spaced from said remainder of said head to form a cavity between said face-piece component and said remainder.

9. The set of golf iron heads in accordance with claim 1, wherein said face-piece component is detachable from said remainder of said head to facilitate replacement of said face-piece component.

10. In a set of golf iron heads, a plurality of said heads each including a plurality of components, one of said components for each of said heads comprising a face-piece component forming at least part of a striking face area of said head, said face-piece component being of a thickness which increases from the top edge to the sole of said head in at least one iron of said set and increases from the sole to the top edge in at least one other iron of said set.

11. The set of golf iron heads in accordance with claim 10, wherein a rear surface of said face-piece is spaced from a main body portion to form a cavity between said face-piece and said main body portion.

12. The set of golf iron heads in accordance with claim 10, wherein said face-piece is detachable from a main body portion to facilitate replacement of said face-piece.

13. A set of iron-type golf club heads, wherein each iron of said set comprises:

a main body portion, and a discrete face-piece fixed to said main body portion, said face-piece having a thickness increasing from toe to heel to locate a center of gravity near said heel in at least one head of said set and increasing from heel to toe to locate said center of gravity near said toe in at least one other head of said set, said location of said center of gravity being in each of said irons different from said location of said center of gravity in other of said irons of said set, said center of gravity being disposed nearest said toe in a longest iron of said set, and said center of gravity being increasingly and respectively disposed nearer the heel of said irons shorter than said longest iron, said center of gravity being disposed nearest said heel in a shortest iron of said set.

14. A set of iron-type golf club heads, wherein each iron of said set comprises:

a main body portion, and a discrete face-piece fixed to said main body portion, said face-piece having a thickness increasing from the top edge to the sole to locate a center of gravity near said sole in a least one head of said set and increases from the sole to the top edge to locate said center of gravity near said top edge in at least one other head of said set, said location of said center of gravity being in each of said irons different from said location of said center of gravity in other of said irons of said set, said center of gravity being disposed nearest said sole in a highest trajectory iron of said set, and said center of gravity being increasingly and respectively disposed nearer the top edge of said irons for irons of lower trajectory than said highest trajectory iron, said center of gravity being disposed nearest said top edge in a shortest trajectory iron.

* * * * *